US007195519B1

(12) United States Patent
McAlonis et al.

(10) Patent No.: US 7,195,519 B1
(45) Date of Patent: Mar. 27, 2007

(54) MODULAR CONNECTOR ASSEMBLY WITH ADJUSTABLE DISTANCE BETWEEN CONTACT WAFERS

(75) Inventors: Matthew Richard McAlonis, Elizabethtown, PA (US); Attalee S. Taylor, Palmyra, PA (US); Richard Elof Hamner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/393,352

(22) Filed: Mar. 30, 2006

(51) Int. Cl.
*H01R 13/58* (2006.01)

(52) U.S. Cl. ..... 439/608; 439/701; 439/717

(58) Field of Classification Search ..... 439/608, 439/701, 707, 709, 712, 541.5, 717
See application file for complete search history.

(56) References Cited

U.S. PATENT DOCUMENTS 4,612,602 A * 9/1986 Weyer et al. ..... 361/730
6,354,877 B1 * 3/2002 Shuey et al. ..... 439/608
6,491,545 B1 * 12/2002 Spiegel et al. ..... 439/579
6,692,305 B2 * 2/2004 Nelson et al. ..... 439/608

* cited by examiner

*Primary Examiner*—Hae Moon Hyeon

(57) ABSTRACT

An electrical connector includes a housing having a mating end and a loading end. First and second contact wafers are loaded into the loading end of the housing. The first and second contact wafers each have a dielectric carrier holding a contact therein. The carriers have outer walls, wherein at least one of the outer walls on each of the carriers has a spacer engagement element provided thereon. A wafer spacer is configured to be positioned between the first and second contact wafers. The wafer spacer is positioned in one of different first and second orientations relative to the side walls of the first and second contact wafers. The wafer spacer has opposed first and second side walls that are separated by a spacer core thickness. The first side wall has a wafer engagement element provided thereon. When the wafer spacer is in the first orientation, the wafer spacer separates the first and second contact wafers by a first distance. When the wafer spacer is in the second orientation, the wafer spacer separates the first and second contact wafers by a second distance that is greater than the first distance.

20 Claims, 8 Drawing Sheets

MODULAR CONNECTOR ASSEMBLY WITH ADJUSTABLE DISTANCE BETWEEN CONTACT WAFERS

BACKGROUND OF THE INVENTION

The invention relates generally to electrical connectors and more particularly to a connector having contact wafers that are separated by an adjustable distance.

Numerous connectors exist for joining signal and power lines between a backplane and a daughter board. Industry standards are often developed to standardize or define certain aspects of board-to-board interfaces. One such standard is the Advanced Telecom Computing Architecture (Advanced TCA) which defines several physical and electrical characteristics. For example, the backplane is divided into zones with zone #1 being defined for power and management, zone #2 for data transport, and zone #3 being user defined rear I/O. Typically, in Advanced TCA compliant communications equipment, the backplane has multiple locations for contacts to plug into receptacles on the backplane. Typically, the connector forms a right angle connector.

The connector may include contacts having a combination of sizes and spacings that vary depending on the connector performance requirements. The Advanced TCA standard determines the location of, and spacing between, the contacts in the power delivery portion of the connector. However, conventional connectors that are configured for use with the Advanced TCA standard require individual manufacture and loading of each signal contact and each power contact into a connector housing. The contacts are individually manufactured and plated. It is then required that the contacts be bent forming a right angle either before or after being loaded into the housing. The manufacturing and assembly processes are slow, labor intensive, and costly.

A need exists for an improved connector design with a reduced part count that can be more economically manufactured.

BRIEF DESCRIPTION OF THE INVENTION

In one aspect of the invention, an electrical connector is provided that includes a housing having a mating end and a loading end. First and second contact wafers are loaded into the loading end of the housing. The first and second contact wafers each have a dielectric carrier holding a contact therein. The carriers have outer walls, wherein at least one of the outer walls on each carrier has a spacer engagement element provided thereon. A wafer spacer is configured to be positioned between the first and second contact wafers. The wafer spacer is positioned in one of different first and second orientations relative to the side walls of the first and second contact wafers. The wafer spacer has opposed first and second side walls that are separated by a spacer core thickness. The first side wall has a wafer engagement element provided thereon. When the wafer spacer is in the first orientation, the wafer spacer separates the first and second contact wafers by a first distance. When the wafer spacer is in the second orientation, the wafer spacer separates the first and second contact wafers by a second distance that is greater than the first distance.

Optionally, the spacer and wafer engagement elements are positioned to mate with one another in a nesting relationship when in the first orientation, such that the first and second contact wafers are spaced apart by the first distance. The wafer engagement element on the wafer spacer abuts against a corresponding outer wall on a corresponding carrier when in the second orientation, such that the first and second contact wafers are spaced apart by the second distance. The wafer spacer is rotated one hundred eighty degrees about a longitudinal axis of the wafer spacer from the first orientation to the second orientation.

In another aspect, an electrical connector is provided that includes a housing having a mating end and a loading end. First and second contact wafers are loaded into the loading end of the housing. The first and second contact wafers each have a dielectric carrier holding a contact therein. The carriers have outer walls. A wafer spacer is configured to be positioned between the first and second contact wafers in one of different first and second orientations relative to the outer walls of the first and second contact wafers. The wafer spacer has opposed first and second side walls that are separated by a spacer core thickness. The first side wall has first and second signal contact channels formed therein. An individual contact is held in one of the first and second signal contact channels in the wafer spacer. When the wafer spacer is in the first orientation, the individual contact is held in the first signal contact channel so that the wafer spacer separates the individual contact and the contacts in the first and second contact wafers by a first distance. When the wafer spacer is in the second orientation, the individual contact is held in the second signal contact channel so that the wafer spacer separates the individual contact and the contacts in the first and second contact wafers by a second distance greater than the first distance.

In yet another aspect, a wafer spacer to be used in a connector between first and second contact wafers is provided. The wafer spacer includes a layer of dielectric material having opposed first and second side walls separated by a core thickness. The dielectric layer is configured to be positioned between the first and second contact wafers in one of different first and second orientations relative to the first and second contact wafers. The first side wall has a wafer engagement element provided thereon. When the dielectric layer is in the first orientation, the dielectric layer separates the first and second contact wafers by a first distance. When the dielectric layer is in the second orientation, the dielectric layer separates the first and second contact wafers by a second distance that is greater than the first distance.

DETAILED DESCRIPTION OF THE INVENTION

Figure 1:
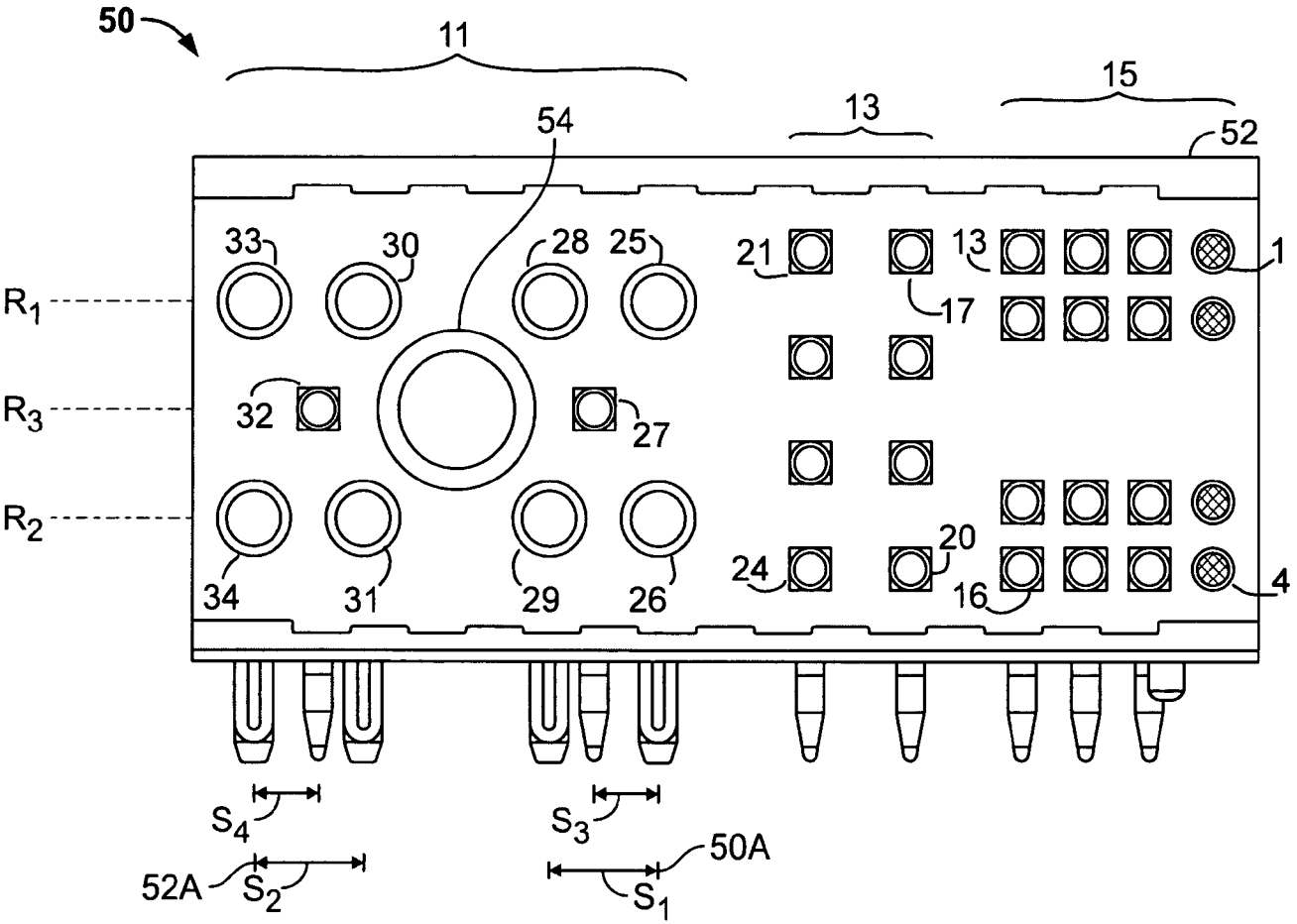
FIG. 1 is a front elevational view of an Advanced TCA compliant power connector formed in accordance with an embodiment of the present invention.

FIG. 1 illustrates a front elevational view of an Advanced Telecom Computing Architecture (Advanced TCA) zone #1 compliant connector 50 formed in accordance with an embodiment of the present invention. The connector 50 includes a main housing body 52 having a guide post 54. The connector 50 is divided into a power delivery portion or zone 11, a first signal delivery portion or zone 13 and a second signal delivery portion or zone 15. Power and signal contacts are numbered one to thirty four starting at the upper right corner of the main housing body 12 and sequentially moving down each column. On each side of the guide post 54, the power delivery portion of the connector 50 includes an array of four power contacts with an inter-nested signal contact. Power contacts 25, 26, 28, and 29 are provided with an inter-nested signal contact 27. Power contacts 25 and 26 are vertically aligned with one another and power contacts 28 and 29 are similarly vertically aligned with one another. Power contacts 30, 31, 33, and 34 are also provided with an inter-nested signal contact 32. Power contacts 30 and 31 are vertically aligned and power contacts 33 and 34 are vertically aligned. The power contacts 25, 28, 30 and 33 are arranged in an upper horizontal row $R_1$. The power contacts 26, 29, 31, and 34 are arranged in a lower horizontal row $R_2$. The signal contacts 27 and 32 are arranged in an intermediate horizontal row $R_3$.

Power contacts 25 and 28 are spaced laterally apart by a distance $S_1$. Power contacts 26 and 29 are also spaced laterally apart by a distance $S_1$. Power contacts 30 and 33 are spaced laterally apart a distance $S_2$. Power contacts 31 and 34 are also spaced laterally apart a distance $S_2$. The distance $S_1$ is different than the distance $S_2$. The power contacts 25 and 26 are aligned along a vertical centerline 50A, while power contacts 33 and 34 are aligned along a vertical centerline 52A. Further, the signal contact 27 is spaced a distance $S_3$ from the vertical centerline 50A through the power contacts 25, 26 and the signal contact 32 is spaced a distance $S_4$ from the vertical centerline 52A through the power contacts 33, 34. The distance $S_3$ is different from the distance $S_4$. For example, the distances $S_1$, $S_2$, $S_3$, and $S_4$ may be determined by Advanced TCA specifications. Also, the contacts vary in length, such as determined by Advanced TCA specifications.

Figure 2:
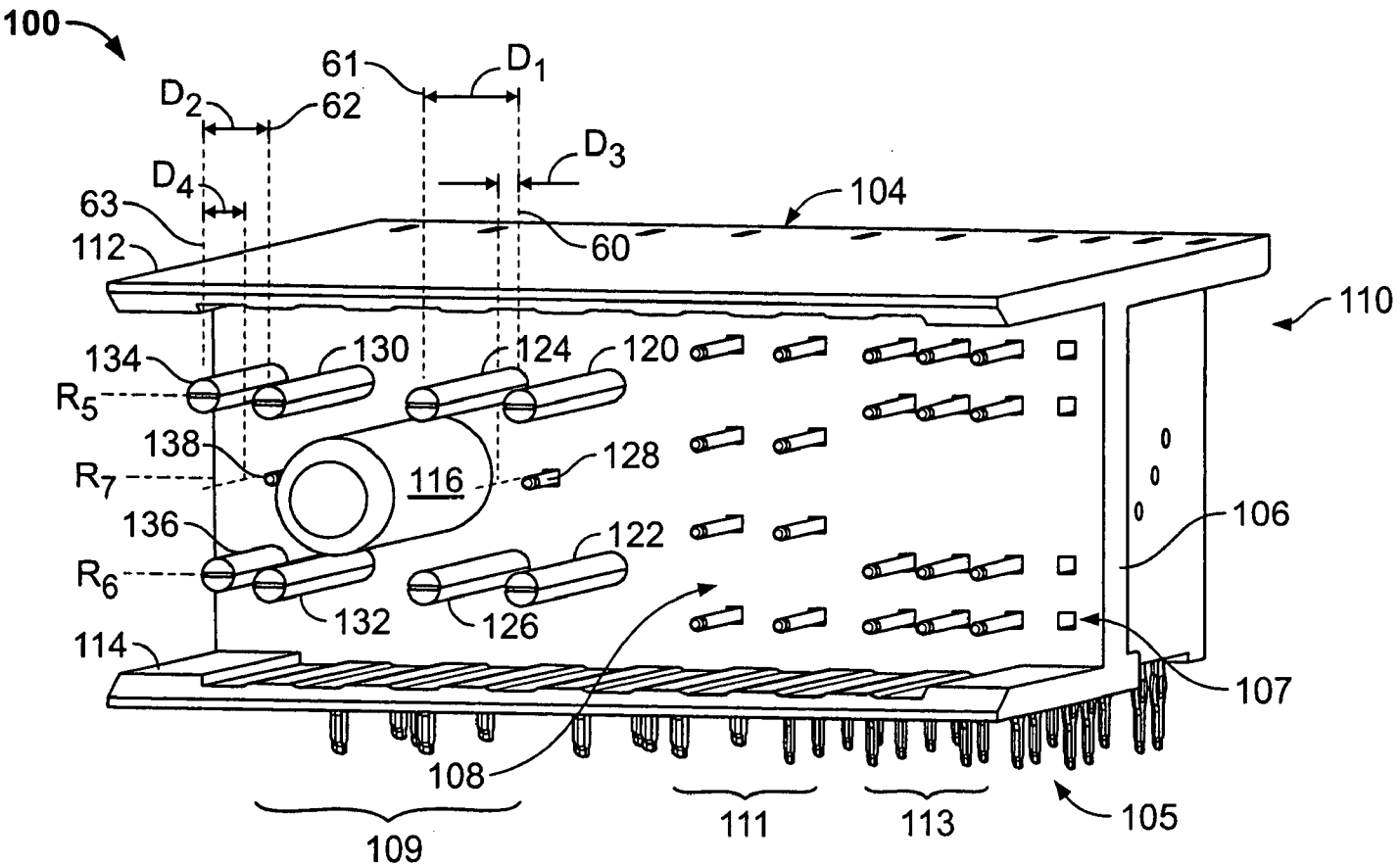
FIG. 2 is a perspective view of a connector formed in accordance with an exemplary embodiment of the present invention.

FIG. 2 illustrates a front perspective view of a connector 100 formed in accordance with an exemplary embodiment of the present invention. While the connector 100 will be described with particular reference to an Advanced TCA compliant connector, it is to be understood that the benefits herein described are also applicable to other connectors in alternative embodiments. The following description is therefore provided for purposes of illustration, rather than limitation, and is but one potential application of the inventive concepts herein.

The connector 100 includes a housing 104 having mounting end 105 and a front wall 106 that separates a mating end 108 from a loading end 110. The housing 104 includes upper and lower shrouds 112 and 114, respectively, that extend forward from the front wall 106 at the mating end 108. A guide post 116 extends from the front wall 106 at the mating end 108. The front wall 106 has a pin pattern 107 therethrough to receive signal and power contacts. The pin pattern 107 includes a power delivery section 109, a first signal section 111, and a second signal section 113.

Power contacts 120, 122, 124, and 126 are grouped with signal contact 128, all of which extend through the front wall 106 on one side of the guide post 116. Power contacts 130, 132, 134, and 136, are grouped with signal contact 138, all of which extend through the front wall 106 on the other side of the guide post 116. Power contacts 120 and 122 are vertically aligned with one another along a vertical center line 60. Similarly, power contacts 124 and 126, power contacts 130 and 132, and power contacts 134 and 136 are aligned along vertical centerlines 61–63. The power contacts 120, 124, 130 and 134 are arranged in an upper horizontal row $R_5$, and the power contacts 122, 126, 132, and 136 are arranged in a lower horizontal row $R_6$. The signal contacts 128 and 138 are arranged in an intermediate horizontal row $R_7$.

Power contacts 120 and 124 are spaced laterally apart by a distance $D_1$. Power contacts 122 and 126 are also spaced laterally apart by a distance $D_1$. Power contacts 130 and 134 are spaced laterally apart a distance $D_2$. Power contacts 132 and 136 are also spaced laterally apart a distance $D_2$. The distance $D_1$ is different from the distance $D_2$. Further, the signal contact 128 is spaced a distance $D_3$ from the vertical centerline 60 through the power contacts 120, 122, and the signal contact 138 is spaced a distance $D_4$ from the vertical centerline 63 through the power contacts 134, 136. The distance $D_3$ is different than the distance $D_4$.

Figure 3:
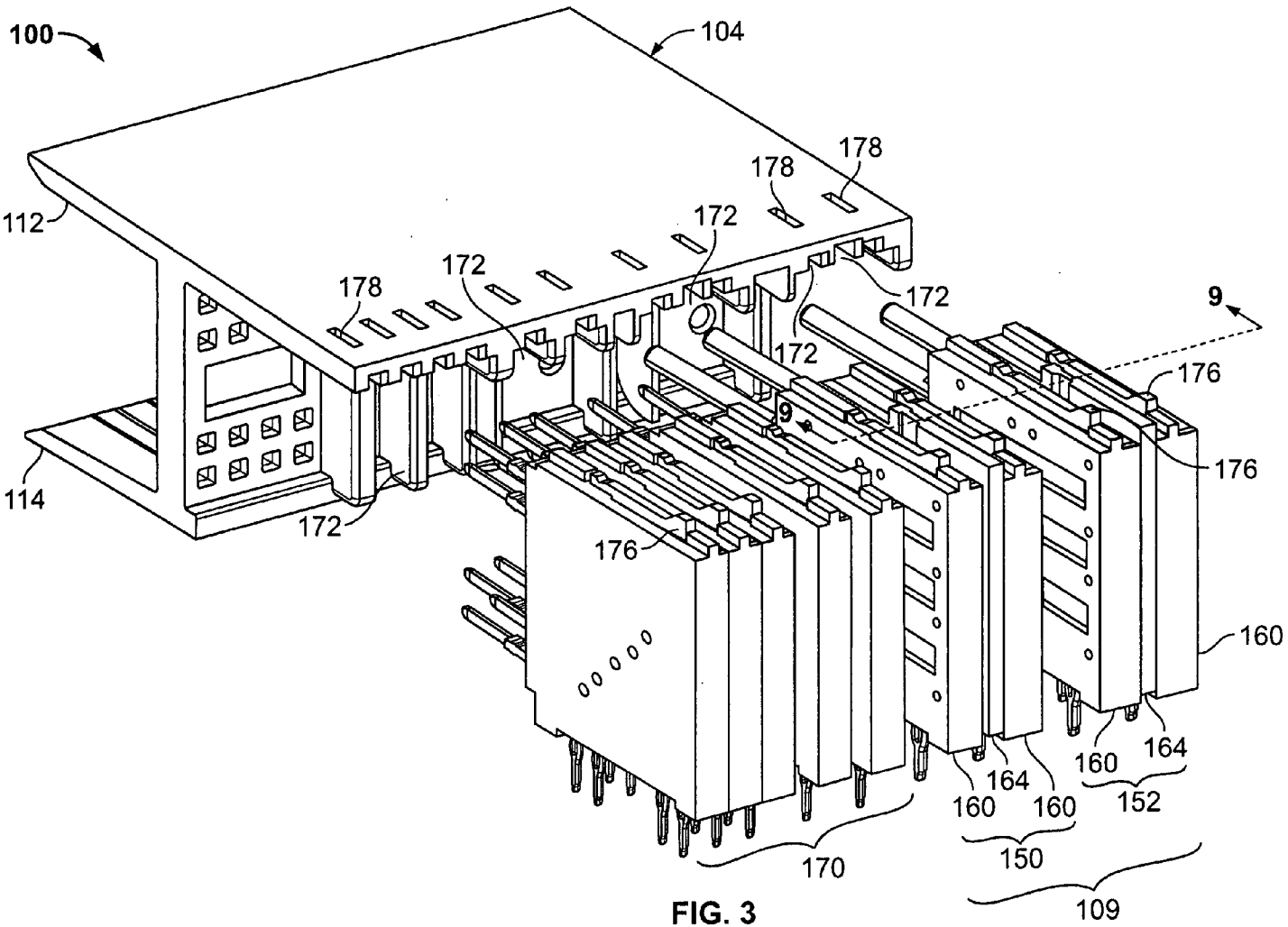
FIG. 3 is an exploded view of the connector of FIG. 2.

FIG. 3 illustrates an exploded rear view of the connector 100. As shown in FIG. 3, the power delivery portion 109 of the connector 100 receives a first power module 150 and a second power module 152. Power module 150 includes power contacts 120, 122, 124, and 126 and signal contact 128 (FIG. 2). Power module 152 includes power contacts 130, 132, 134, and 136 and signal contact 138 (FIG. 2). Each power module 150, 152 includes a pair of power contact wafer assemblies 160 separated by a wafer spacer 164. The power contact wafer assemblies 160 may be identical and interchangeable.

Contacts in the signal sections 111 and 113 (FIG. 2) of the connector 100 are also carried in wafer assemblies 170 that may or may not be interchangeable with one another. Each of the wafer assemblies 160 and wafer spacers 164, as well as wafer assemblies 170 are received through the loading end 110 (FIG. 2) into respective slots 172 formed in the connector housing 104. Each wafer assembly 160, 170 also includes a latch 176 that is received in windows 178 to lock the wafer assembly in the housing 104. Each wafer assembly 160 and 170 is formed with a contact lead frame enclosed in a dielectric carrier.

Figure 4:
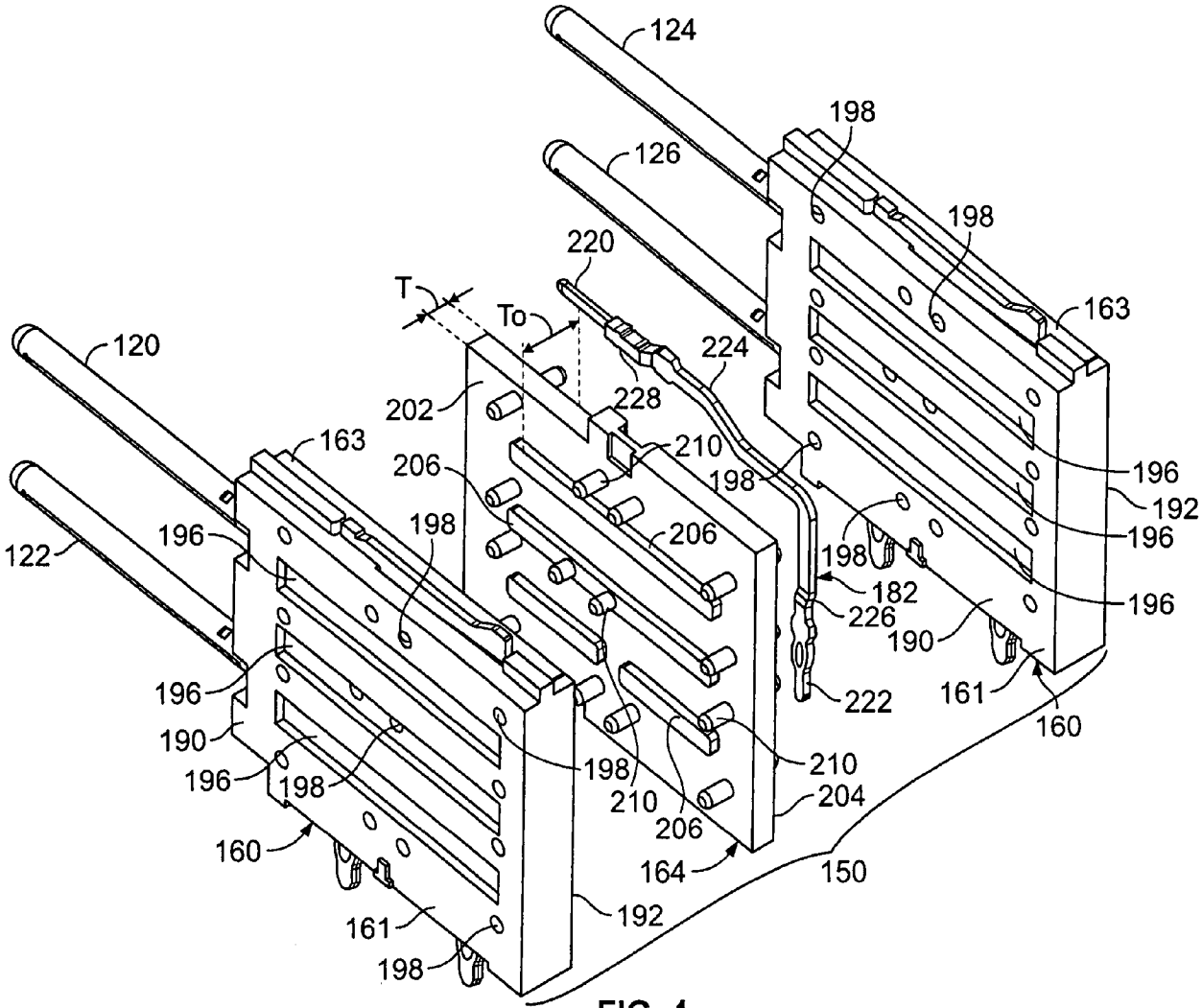
FIG. 4 is an exploded view of a module formed in accordance with an exemplary embodiment of the present invention.
Figure 5:
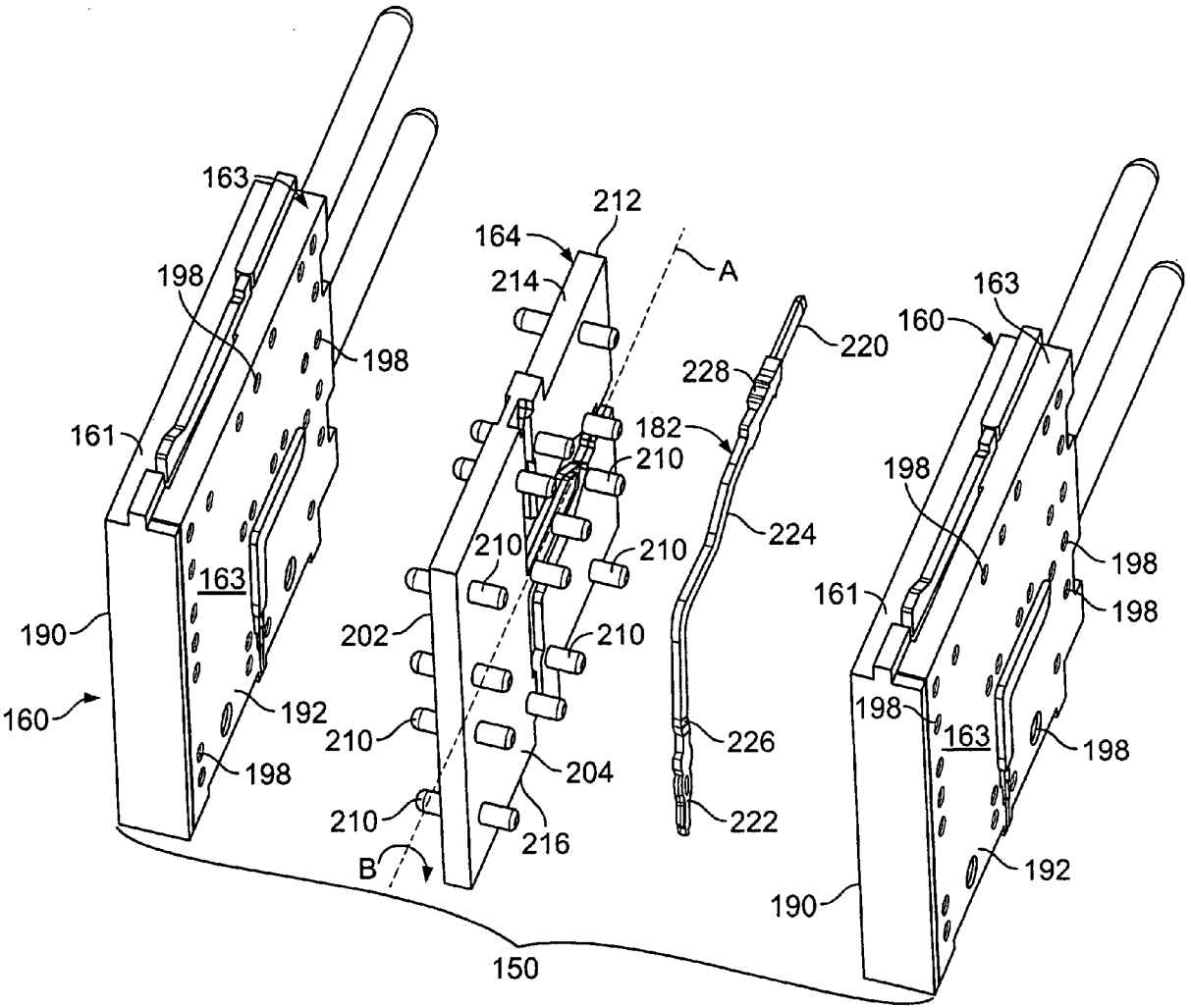
FIG. 5 is an exploded view of the module of FIG. 4.

FIGS. 4 and 5 illustrate exploded views of the power module 150. The power module 150 includes a first power contact wafer assembly 160, a wafer spacer 164, a signal contact lead 182, and a second power contact wafer assembly 160. Each power contact wafer assembly 160 includes a carrier formed with an insulative base 161 and cover 163 that enclose one or more power contacts 120 and 122, or 124 and 126 therein. The base 161 has an outer first wall 190, while the cover 163 has an outer second wall 192. The first and second outer walls 190 and 192 are substantially parallel to one another. The first outer wall 190 includes a number of spacer engagement elements 196 formed therein. In one embodiment, the spacer engagement elements 196 constitute slots formed in the outer wall 190. In some embodiments, the spacer engagement elements, or slots, 196 are rectangular in shape, however, in other embodiments, other shapes may be employed. Both the first outer wall 190 and the second outer wall 192 include a plurality of holes 198. In one embodiment, the holes 198 may be circular in shape, however other shapes may be used in other embodiments.

The wafer spacer 164 is formed from a layer of dielectric material having a spacer core thickness T between a first side wall 202 and an opposite second side wall 204. The first and second side walls 202 and 204, respectively, are substantially parallel to one another. The wafer spacer 164 extends along a longitudinal axis A and is configured to be received and sandwiched between a pair of adjacent power contact wafer assemblies 160. The wafer spacer 164 may be positioned in one of two orientations by flipping the wafer spacer 164 about the longitudinal axis A such as denoted by the arrow B. The first side wall 202 includes a number of wafer engagement elements or protrusions 206 that are configured to be received in the spacer engagement elements 196 in a nesting relationship when the first side wall 202 of the wafer spacer 164 is oriented to face the first outer wall 190 of the base 161 of a power contact wafer 160. Both the first side wall 202 and the second side wall 204 of the wafer spacer 164 include a plurality of pegs 210 that are received in the holes 198 in the first and second outer walls 190 and 192, respectively, when the wafer spacer 164 is sandwiched between the power contact wafers 160.

Each power contact wafer assembly 160 includes a pair of power contacts, such as in FIG. 2, power contacts 120 and 122, power contacts 124 and 126, power contacts 130 and 132, or power contacts 134 and 136 depending on the position in the power modules 150 and 152. The wafer spacer 164 establishes and maintains the power contact spacings $D_1$ and $D_2$ (FIG. 2) within the power modules 150 and 152 depending on the orientation of the wafer spacer 164 within the power modules 150 and 152 as will be described. In one orientation of the wafer spacer 164, a gap 166 (FIG. 3) is produced between the wafer spacer 164 and the power contact wafer assembly 160 as in power module 150. In another orientation, the wafer spacer 164 fits flush with the power contact wafer assembly as shown in power module 152. The wafer spacer 164 also holds a signal contact that may be either signal contact 128 or signal contact 138 depending on the power module, 150 or 152, in which the wafer spacer 164 is placed. The orientation of the wafer spacer 164 also establishes and maintains the spacings $D_3$ and $D_4$ within the power modules 150 and 152 as will be described.

The wafer spacer 164 establishes and maintains the spacings $D_1$ and $D_2$ between the power contacts (see FIG. 2). The wafer spacer 164 is positionable in one of a first orientation to establish a first power contact spacing and a second orientation when the wafer spacer 164 is rotated 180° from the first orientation about the longitudinal axis A to establish a second power contact spacing that is different than the first power contact spacing. In one orientation, the wafer engagement elements 206 abut the second outer wall 192 of the cover 163 on the power contact wafer 160 to establish the greater of the power contact spacings $D_1$ and $D_2$. When the wafer engagement elements 206 are in abutting engagement with the second outer wall 192, the gap 166 (see FIG. 9) is created. When the wafer spacer 164 is oriented so that the wafer engagement elements 206 are received in the spacer engagement elements 196 in the first outer wall 190 of the base 161 of the power contact wafer 160, the first side wall 202 of the wafer spacer 164 fits flush against the first outer wall 190 to establish the lesser of the power contact spacings $D_1$ and $D_2$. Additionally, when the wafer spacer 164 fits flush with first outer wall 190, there is no gap or space between the wafer spacer 164 and the power contact wafer 160. The wafer spacer 164 generally separates the power contact wafers 160 by first and second distances. The wafers 160 are spaced apart a first distance when the wafer engagement elements 206 are mated with the spacer engagement elements 196 in a nesting relationship. The wafer engagement elements 206 extend outward from the first side wall 202 of the wafer spacer 164 to define a spacer outer thickness $T_o$. The outer thickness $T_o$ defines a second spacing between the power contact wafers 160 wherein the wafer engagement elements 206 abut the second outer wall 192 of the cover 163.

The wafer spacer 164 has a forward edge 212, a first edge 214 and a second edge 216 opposite the first edge 214. The signal contact lead 182 includes a mating contact end 220, a mounting contact end 222, and a main body 224. The signal contact lead 182 is formed with a jog 226 proximate the mounting contact end 222. A thickened section 228 is formed at the mating contact end 220 and from which the mating end 220 extends. The thickened section 228 shifts the mating contact end 220 back into alignment with the mounting contact end 222. Thus, the signal contact lead 182 is asymmetrical with respect to the main body 224.

Figure 6:
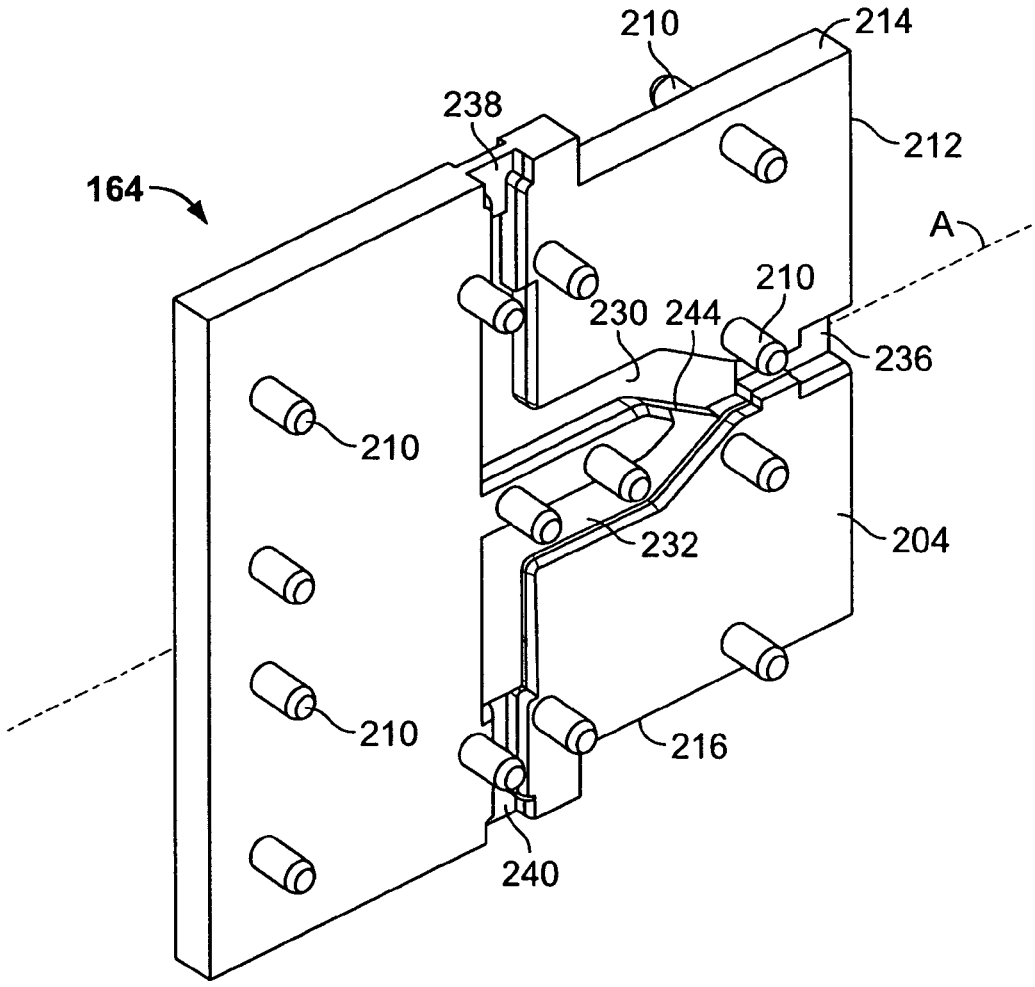
FIG. 6 is a perspective view of a spacer formed in accordance with an exemplary embodiment of the present invention.

FIG. 6 illustrates a detail view of the second side wall 204 of the wafer spacer 164. The second side wall 204 of the wafer spacer 164 includes a first signal contact channel 230 and a second signal contact channel 232. The signal contact lead 182 (FIG. 5) is held in one of the first or second signal contact channels 230, 232 in the wafer spacer 164. The first signal contact channel 230 and the second signal contact channel 232 are formed in a T-shape and have a common mating end exit 236 in the forward edge 212 of the wafer spacer 164. The first signal contact channel 230 has a mounting end exit 238 formed in the first edge 214 of the wafer spacer 164. The second signal contact channel 232 has a mounting end exit 240 formed in the second edge 216 of the wafer spacer 164. The mounting end exits 238 and 240 are arranged in an opposed relation on opposite first and second edges 214 and 216. A step 244 between the first signal contact channel 230 and the second signal contact channel 232 is provided to accommodate the thickened section 228 (FIG. 5) of the signal contact lead 182 when the signal contact lead 182 is held in the second contact channel 232. The signal contact channels 230, 232 are formed with depths that, together with the core thickness T of the wafer spacer 164, cooperate to establish the different signal contact to power contact spacings $D_3$ and $D_4$ (FIG. 2). The wafer spacer 164 is rotatable about the longitudinal axis A so that the mounting end exit 238, 240 of the selected signal contact channel 230 or 232 is oriented toward the mounting end 105 (FIG. 2) of the connector 100.

Figure 7:
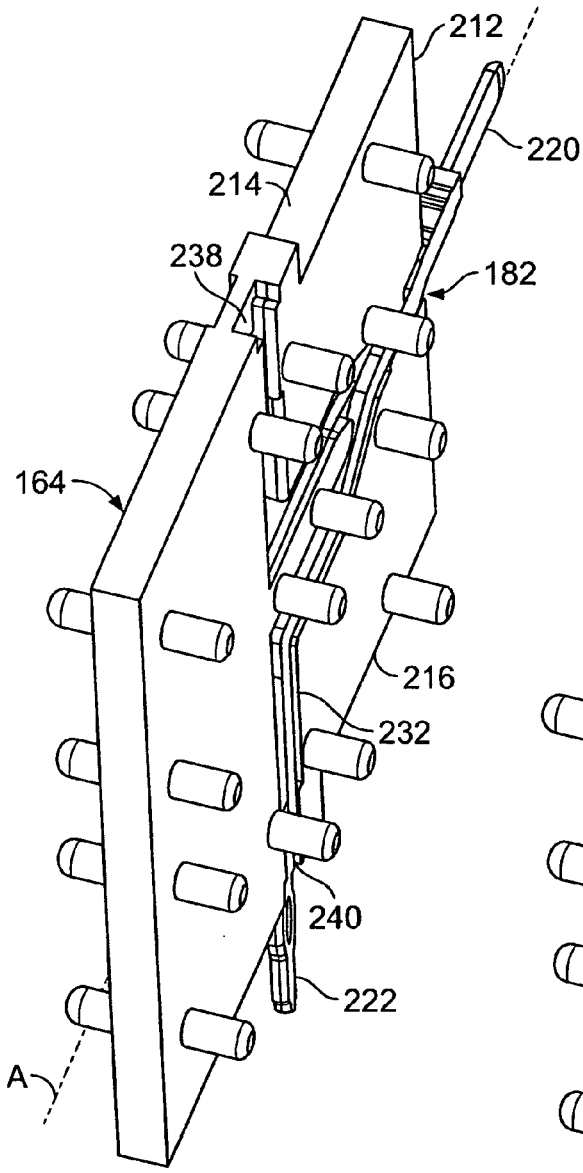
FIG. 7 is a side perspective view of a signal contact lead and a module spacer mounted together in one orientation.
Figure 8:
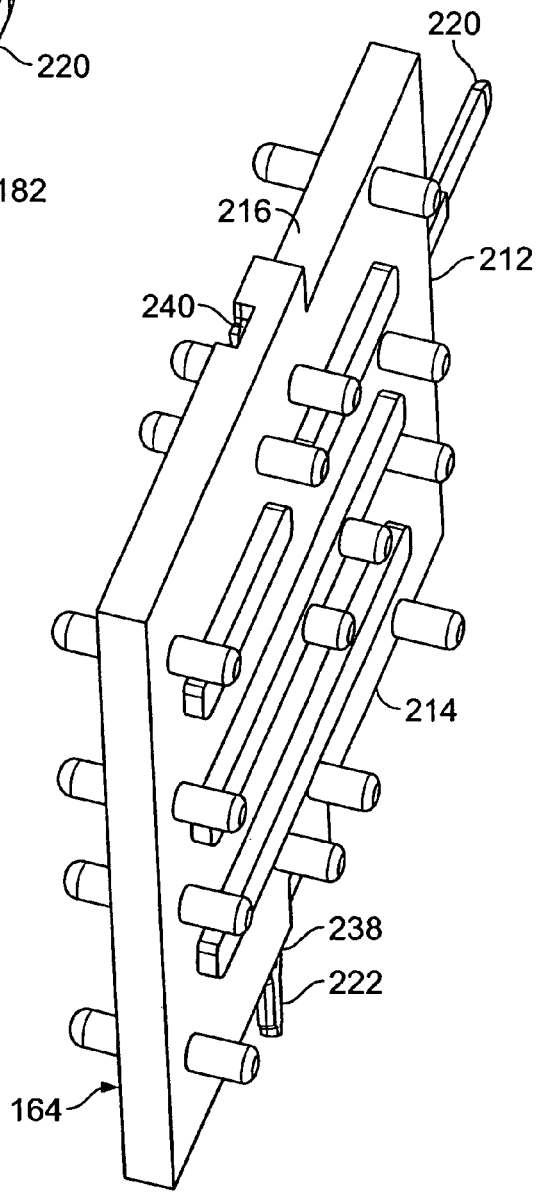
FIG. 8 is a side perspective view of the signal contact lead and module spacer shown in FIG. 7 mounted together in another orientation.

FIG. 7 illustrates the signal contact lead 182 mounted in the second signal contact channel 232. FIG. 8 illustrates the signal contact lead 182 mounted in the first signal contact channel 230 (FIG. 6). In FIG. 7, the signal contact lead 182 is mounted in the second signal contact channel 232 with the mounting contact end 222 extending through the second mounting end exit 240 in the second edge 216 in the wafer spacer 164. In FIG. 8, the signal contact lead 182 is mounted in the first signal contact channel 230 with the mounting contact end 222 extending through the first mounting end exit 238 in the first edge 214 in the wafer spacer 164. The wafer spacer 164 is rotated about the longitudinal axis A to position or orient the mounting contact end 222 of the signal lead 182 toward the mounting end 105 (FIG. 2) of the connector 100.

Figure 9:
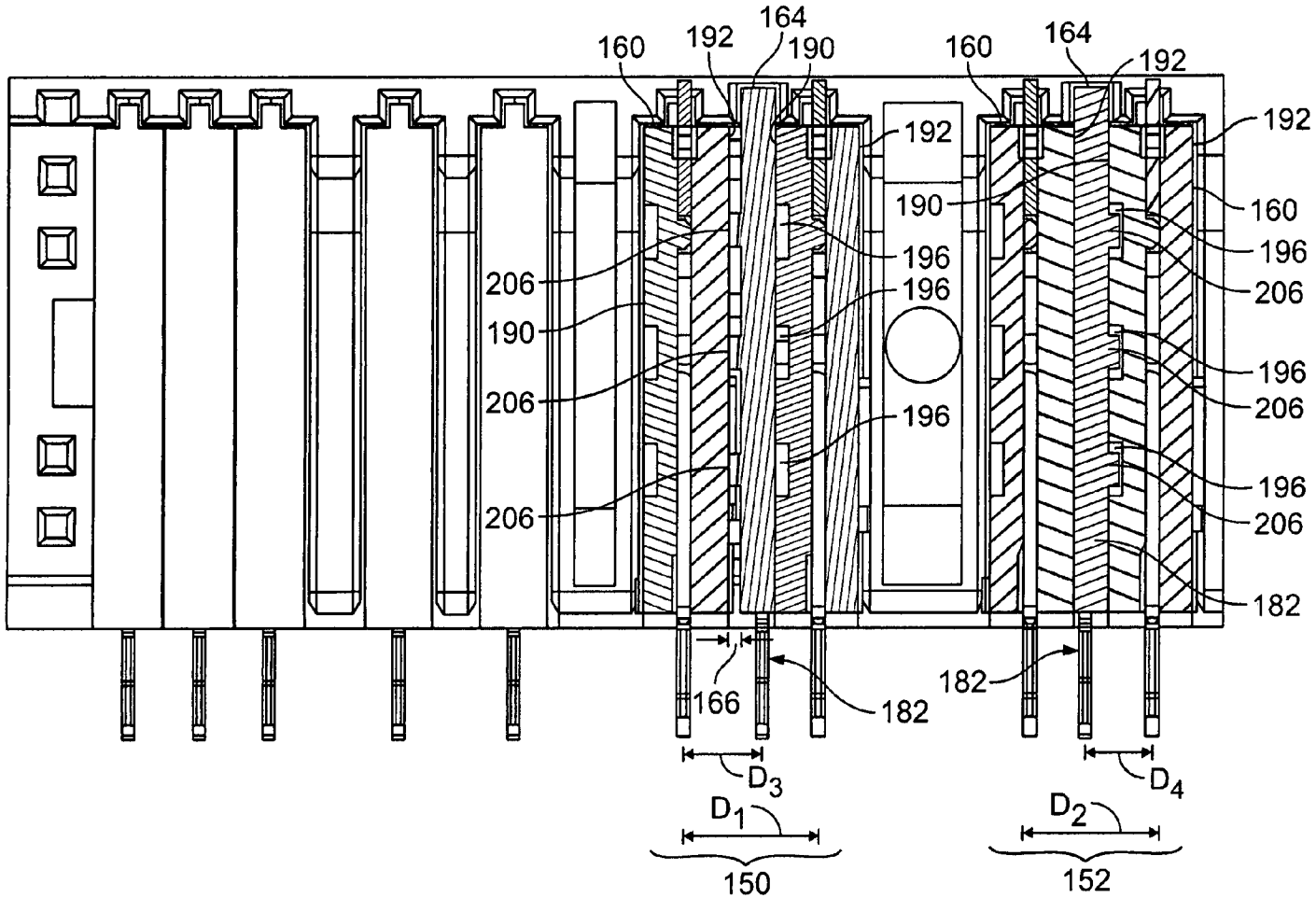
FIG. 9 is a cross sectional view taken along the line 9—9 of FIG. 3.

FIG. 9 illustrates a cross sectional view of the power modules 150 and 152 taken along the line 9—9 of FIG. 3.

In the power module 150, the wafer engagement elements 206 on the wafer spacer 164 abut the second outer wall 192 of the cover 163 (FIG. 5) of the power contact wafer 160 creating the gap 166. The wafer spacer 164 is oriented to establish the power contact spacing $D_1$. The signal lead 182 is mounted in the second signal contact channel 232 (FIG. 6) with the signal contact to power contact spacing $D_3$ resulting. In the power module 152, the wafer engagement elements 206 on the wafer spacer 164 are received in the spacer engagement elements 196 on the first outer wall 190 of the base 161 (FIG. 5) in a nesting relationship such that the wafer spacer 164 fits flush with the power contact wafer assembly 160. The wafer spacer 164 is rotated 180° about the longitudinal axis A (FIG. 7) from the orientation in the power module 150 to establish the power contact spacing $D_2$. The signal lead 182 is mounted in the first signal contact channel 230 (FIG. 6) to establish the signal to power contact spacing $D_4$.

The embodiments thus described provide a power connector 100 that is Advanced TCA compliant and that controls contact spacings with a wafer spacer 164 between power contact wafer assemblies 160. The power contacts are formed in interchangeable wafers 160 thereby reducing the overall piece count and manufacturing cost for the connector 100. The wafer spacer has a longitudinal axis and is rotatable about the longitudinal axis to establish different power contact spacings $D_1$ and $D_2$. The wafer spacer 164 also is formed with two signal contact channels in which the signal contact lead may be mounted depending upon the orientation of the wafer spacer 164. The signal contact channels and the wafer spacer core thickness establish the signal contact to power contact spacings $D_3$ and $D_4$.

While the invention has been described in terms of various specific embodiments, those skilled in the art will recognize that the invention can be practiced with modification within the spirit and scope of the claims.

What is claimed is:

1. An electrical connector comprising:

a housing having a mating end and a loading end;

first and second contact wafers to be loaded into the loading end of the housing, the first and second contact wafers each having a dielectric carrier holding a contact therein, the carriers having outer walls, wherein at least one of the outer walls on each of the carriers has a spacer engagement element provided thereon; and a wafer spacer configured to be positioned between the first and second contact wafers in one of different first and second orientations relative to the outer walls of the first and second contact wafers, the wafer spacer having opposed first and second side walls that are separated by a spacer core thickness, the first side wall having a wafer engagement element provided thereon, when the wafer spacer is in the first orientation, the wafer spacer separating the first and second contact wafers by a first distance and, when the wafer spacer is in the second orientation, the wafer spacer separating the first and second contact wafers by a second distance that is greater than the first distance.

2. The electrical connector of claim 1, wherein the spacer and wafer engagement elements are positioned to mate with one another in a nesting relationship when in the first orientation, such that the first and second contact wafers are spaced apart by the first distance.

3. The electrical connector of claim 1, wherein the wafer engagement element extends outward from the first side wall to define a spacer outer thickness, the spacer outer thickness defining the second distance.

4. The electrical connector of claim 1, wherein the wafer engagement element on the wafer spacer abuts against a corresponding outer wall on a corresponding carrier, when in the second orientation, such that the first and second contact wafers are spaced apart by the second distance.

5. The electrical connector of claim 1, wherein the wafer spacer is rotated one hundred eighty degrees about a longitudinal axis of the wafer spacer from the first orientation to the second orientation.

6. The connector of claim 1, wherein the wafer and spacer engagement elements constitute slots and protrusions that are configured to mate with one another when aligned.

7. The connector of claim 1, wherein one of the outer walls on the carriers includes a plurality of holes formed therein, and one of the side walls on the contact wafers includes a plurality of pegs formed thereon, each of the pegs being received in a respective one of the holes.

8. An electrical connector comprising:

a housing having a mating end and a loading end;

first and second contact wafers to be loaded into the loading end of the housing, the first and second contact wafers each having a dielectric carrier holding a contact therein, the carriers having outer walls; and a wafer spacer configured to be positioned between the first and second contact wafers in one of different first and second orientations relative to the outer walls of the first and second contact wafers, the wafer spacer having opposed first and second side walls that are separated by a spacer core thickness, the first side wall having first and second signal contact channels formed therein; and an individual contact held in one of said first and second signal contact channels in the wafer spacer;

wherein, when the wafer spacer is in the first orientation, the individual contact is held in the first signal contact channel so that the wafer spacer separates the individual contact and the contacts in the first and second contact wafers by a first distance and, when the wafer spacer is in the second orientation, the individual contact is held in the second signal contact channel so that the wafer spacer separates the individual contact and the contacts in the first and second contact wafers by a second distance greater than the first distance.

9. The electrical connector of claim 8, wherein one of the outer walls and the first side wall have spacer and wafer engagement elements, respectively, that are positioned to mate with one another in a nesting relationship, when the wafer spacer is in the first orientation.

10. The electrical connector of claim 8, wherein the first side wall of the wafer spacer includes a wafer engagement element that abuts against the outer wall, when the wafer spacer is in the second orientation.

11. The electrical connector of claim 8, wherein the wafer spacer is rotated one hundred eighty degrees about a longitudinal axis of the wafer spacer from the first orientation to the second orientation.

12. The electrical connector of claim 8, wherein the first and second signal contact channels are formed in a T-shape and join at a common mating end exit and have opposed mounting end exits.

13. The electrical connector of claim 8, wherein the wafer spacer includes a forward edge and first and second opposite side edges, the individual contact includes a mating end and a mounting end, and the first and second signal contact channels include common mating end exits at the forward edge of the wafer spacer and the first contact channel includes a mounting end exit at the first side edge and the second contact channel includes a mounting end exit at the second side edge.

14. A wafer spacer to be used in a connector between first and second contact wafers, said wafer spacer comprising:

a layer of dielectric material having opposed first and second side walls separated by a core thickness, the dielectric layer being configured to be positioned between the first and second contact wafers in one of different first and second orientations relative to the first and second contact wafers, the first side wall having a wafer engagement element provided thereon, wherein, when the dielectric layer is in the first orientation, the dielectric layer separates the first and second contact wafers by a first distance and, when the dielectric layer is in the second orientation, the dielectric layer separates the first and second contact wafers by a second distance that is greater than the first distance.

15. The wafer spacer of claim 14, wherein said wafer engagement element on the dielectric layer is configured to be received in a spacer engagement element formed in an outer wall on one of the first and second contact wafers.

16. The wafer spacer of claim 14, wherein the wafer engagement element on the dielectric layer is configured to abut against the outer wall of one of the first and second contact wafers when in the second orientation, such that the first and second contact wafers are spaced apart by the second distance.

17. The wafer spacer of claim 14, wherein each of said contact wafers includes a first and second outer wall and the first and second side walls of the dielectric layer include a plurality of pegs formed thereon, each said peg configured to be received in a respective one of a plurality of holes formed in the first and second outer walls of the contact wafers.

18. The wafer spacer of claim 14, wherein the dielectric layer further comprises first and second signal contact channels configured to hold an individual contact, the first signal contact channel being configured to establish a first contact spacing between the individual contact and the contacts in the first and second contact wafers, and the second signal contact channel being configured to establish a second contact spacing between the individual contact and the contacts in the first and second contact wafers that is different from the first contact spacing, wherein said dielectric layer is positioned in the first orientation when the individual contact is held in said first signal contact channel and the second orientation when the individual contact is held in said second signal contact channel.

19. The wafer spacer of claim 14, wherein the dielectric layer further comprises first and second signal contact channels formed in a T-shape and having common mating end exits and opposed mounting end exits.

20. The wafer spacer of claim 14, wherein the dielectric layer further comprises first and second signal contact channels and an individual contact held in one of the first and second signal contact channels, and wherein the dielectric layer includes a forward edge and first and second opposite side edges, the individual contact having a mating end and a mounting end, and the first and second signal contact channels include common mating end exits at the forward edge of the dielectric layer and the first contact channel includes a mounting end exit at the first side edge of the dielectric layer and the second contact channel includes a mounting end exit at the second side edge of the dielectric layer.

* * * * *